United States Patent [19]

Teegarden et al.

[11] 4,383,805

[45] May 17, 1983

[54] GAS COMPRESSOR OF THE SCROLL TYPE HAVING DELAYED SUCTION CLOSING CAPACITY MODULATION

[75] Inventors: Arlo F. Teegarden, Stoddard; Robert E. Utter, Onalaska, both of Wis.

[73] Assignee: The Trane Company, La Crosse, Wis.

[21] Appl. No.: 202,967

[22] Filed: Nov. 3, 1980

[51] Int. Cl.[3] ..... F04B 49/02; F04B 49/08; F04C 18/02

[52] U.S. Cl. ..... 417/308; 417/310; 417/440; 418/55

[58] Field of Search ..... 417/308, 310, 440; 418/55, 57, 59

[56] References Cited

U.S. PATENT DOCUMENTS

| | | | |
|---|---|---|---|
| 2,519,913 | 8/1950 | Lysholm | 417/440 |
| 3,295,752 | 1/1967 | Bellmer | 417/310 |
| 4,065,279 | 12/1977 | McCullough | 418/55 |
| 4,068,981 | 1/1978 | Mandy | 417/310 |
| 4,222,715 | 9/1980 | Ruf | 417/310 |
| 4,314,796 | 2/1982 | Terauchi | 418/55 |
| 4,332,535 | 6/1982 | Terauchi et al. | 418/55 |

*Primary Examiner*—John J. Vrablik

*Attorney, Agent, or Firm*—Carl M. Lewis; Peter D. Ferguson; Ronald M. Anderson

[57] ABSTRACT

A gas compressor of the scroll type is disclosed wherein unloader means are provided for selectively varying its capacity by effectively delaying the point at which the closed moving volumes defined between the wrap elements begin compression. To this end, passage means extend through the end plate means of the compressor from a location in communication with the closed moving volumes to a location in communication with working gas normally at suction pressure during operation of the compressor. Valve means are provided for selectively blocking flow through the aforementioned passage means, whereby the compressor operates at a relatively high capacity; and for permitting flow through the passage means, whereby gas is exhausted via the passage means to suction pressure as the closed moving volumes progress radially inwardly to a predetermined position at which compression is permitted to begin.

12 Claims, 12 Drawing Figures

FIG. 4(a)
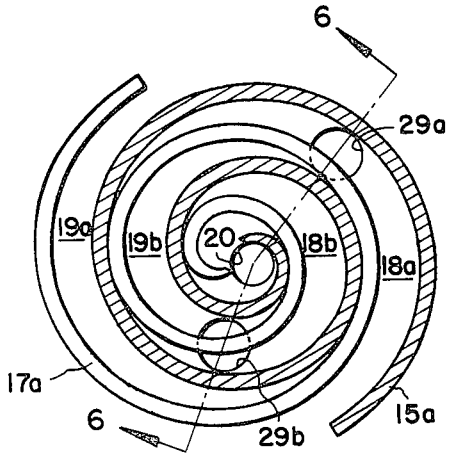
FIG. 4(b)
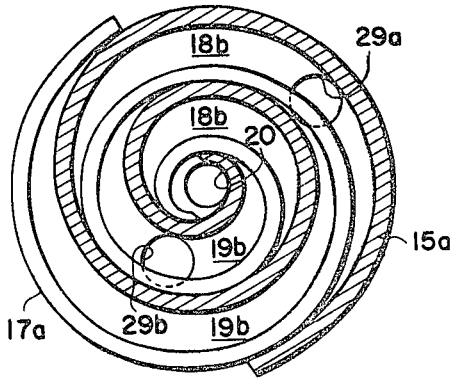
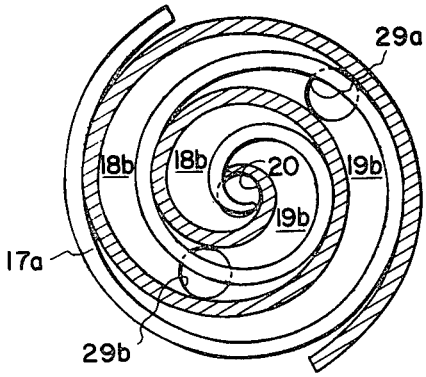
FIG. 4(c)
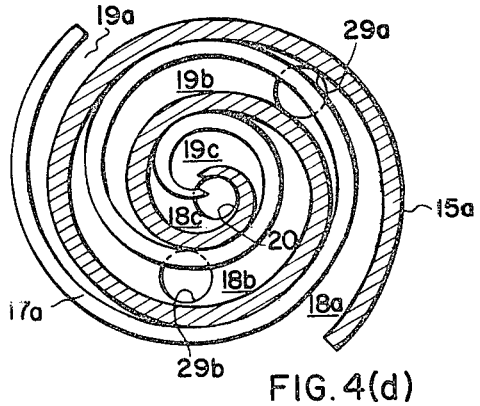
FIG. 4(d)
FIG. 3
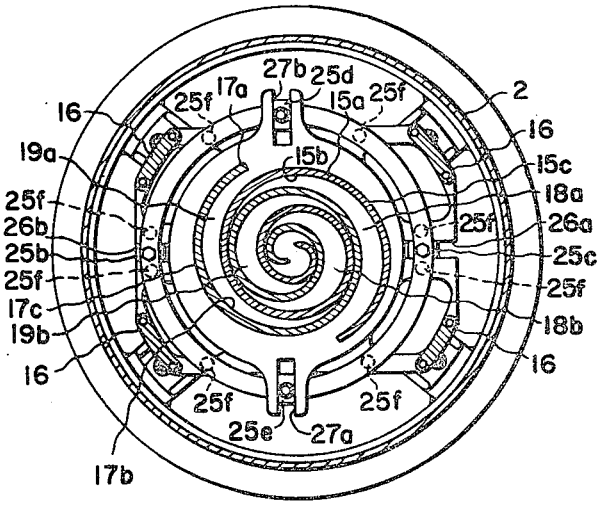

FIG. 5(a)
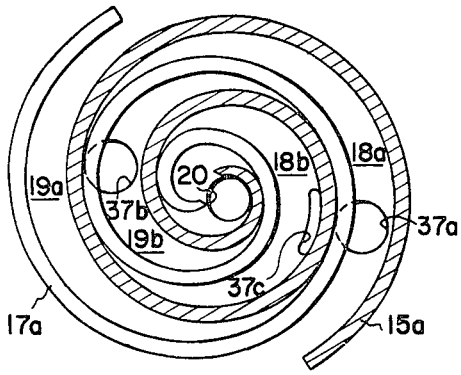
FIG. 5(b)
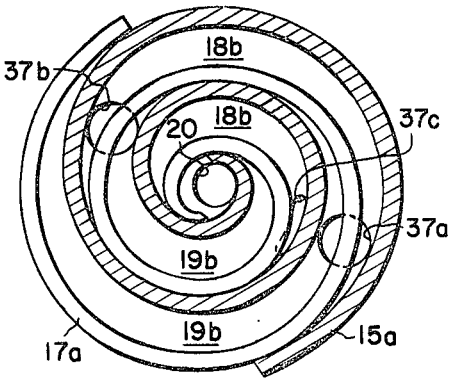
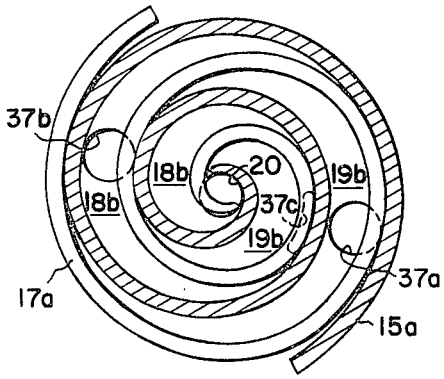
FIG. 5(c)
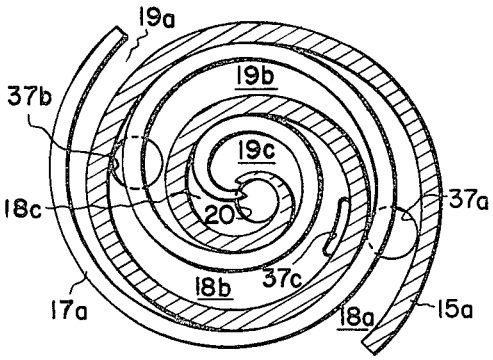
FIG. 5(d)
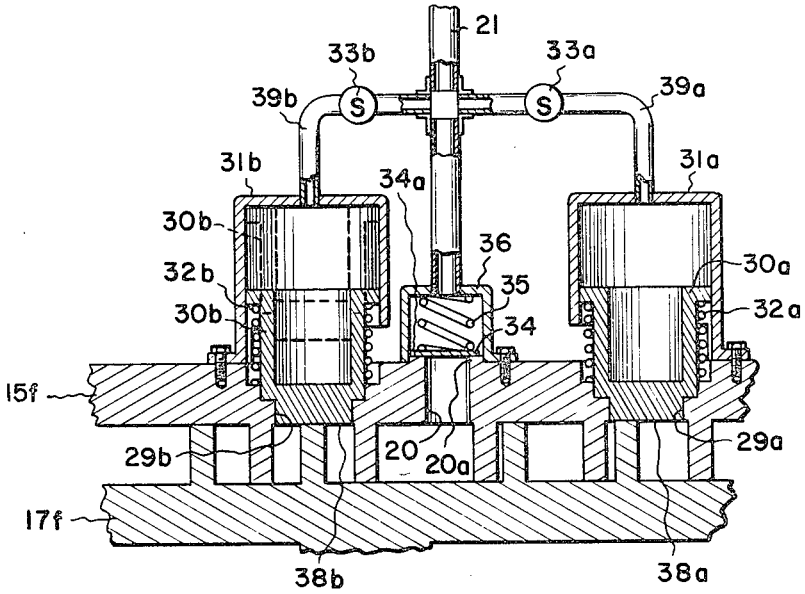
FIG. 6

GAS COMPRESSOR OF THE SCROLL TYPE HAVING DELAYED SUCTION CLOSING CAPACITY MODULATION

TECHNICAL FIELD

The present invention relates generally to the field of gas compressors of the scroll type, and is particularly directed to such a compressor capable of operation at variable capacities so as to have utility in the field of refrigeration and air conditioning, or other applications wherein a compressor of variable capacity is indicated.

BACKGROUND ART

In the field of positive displacement fluid apparatus, there exists a class or category generally referred to as scroll-type fluid apparatus which are characterized by the provision of wrap elements defining flank surfaces of generally spiroidal configuration about respective axes, which wrap elements lie in intermeshing, angularly offset relationship with their axes generally parallel such that relative orbital motion between the wrap elements results in the formation of one or more moving volumes between the wrap elements, defined by moving lines of coaction between the wrap elements at which their flank surfaces lie substantially tangent to each other. In a preferred form, the precise shape of the generally spiroidal flank surfaces comprise an involute of a circle, however, the term "generally spiroidal" is intended to encompass any form providing the requisite moving volumes during relative orbital motion between the wrap elements. Typically, end plate means are provided in sealing relationship to the wrap elements as they undergo relative orbital motion such that the moving volumes are effectively sealed. Reference may be had to U.S. Pat. No. 801,182 for an early disclosure of scroll-type fluid apparatus embodying this principle, or to U.S. Pat. No. 3,884,599 for a more recent disclosure.

It has been recognized that scroll-type fluid apparatus have utility in a wide variety of applications, including gas compressors or vacuum pumps for elevating the pressure of a gaseous working fluid; liquid pumps for transporting a liquid working fluid; or as an expansion engine for producing mechanical work by the expansion of a relatively high pressure gaseous working fluid. In the case of a gas compressor, the moving volumes defined between wrap elements originate at a radially outer portion thereof and progress inwardly while their volume is reduced, resulting in compression of the working gas which is then discharged at a radially inner portion of the wrap elements. Liquid pumps function in a similar fashion with the wrap elements configured such that no appreciable reduction in volume occurs as the volumes progress radially inwardly, while scroll-type expansion engines receive a relatively high pressure gaseous working fluid at the radially inner portion of their wrap elements, which then progresses radially outwardly in the moving volumes as they increase in volume, resulting in expansion of the working fluid and production of mechanical work.

In considering the kinematic relationship necessary in order to effect the requisite relative orbital motion between the wrap elements, it should be noted that at least three general approaches exist:

(1) maintaining one wrap element fixed while orbiting the other with respect thereto, i.e., causing it to undergo circular translation while maintaining a fixed angular relationship between the wrap elements;

(2) orbiting both wrap elements in opposite directions while maintaining a fixed angular relationship therebetween; and (3) rotating both wrap elements about offset parallel axes while maintaining a fixed angular relationship therebetween.

A second consideration relevant to the relative orbital motion between wrap elements is the manner in which their flank surfaces are permitted to coact with each other; i.e., is actual contact permitted therebetween along the lines at which the surfaces lie substantially tangent, accompanied by a radial sealing force therebetween; or are constraints imposed thereon so as to maintain a slight clearance or gap therebetween. In this regard, it is convenient to term the former as "radially compliant" type, while the latter may be referred to as "fixed-crank" type. As used herein, the term "moving line coaction" is intended to be descriptive of both types, while the term "actual moving line contact" is limited to the radially compliant type. Reference may be had to U.S. Pat. No. 3,924,977 for disclosure of a radially compliant type drive mechanism, while U.S. Pat. No. 4,082,484 is illustrative of the fixed-crank type.

In many applications wherein gas compressors are utilized, it is desirable that the compressor be provided with variable capacity operation; particularly, in the field of refrigeration and air conditioning wherein gas compressors are utilized to compress a refrigerant gas such as Freon (a trademark of Du Pont), it is desirable that a particular refrigeration system be of variable capacity as to match the cooling or heating output of the system to the demand therefore at any particular time. To satisfy this need, many such systems today utilize centrifugal or reciprocating gas compressors provided with means for varying their capacity. It would, however, due to certain advantages associated with gas compressors of the scroll type, be desirable that this type compressor be provided with means for selectively varying its capacity so as to enable its application in the field of refrigeration and air conditioning, or in other applications where such variable capacity operation is required.

DISCLOSURE OF THE INVENTION

In accordance with the present invention, a gas compressor of the scroll type includes first and second wrap elements defining respective flank surfaces of generally spiroidaL configuration about their axes, the wrap elements being disposed in intermeshing, angularly offset relationship with their axes generally parallel, and with end plate means in overlying, substantially sealing relationship to first and second axial tip portions of the wrap elements. Drive means are provided for effecting relative orbital motion between the wrap elements such that moving line coaction between the flank surfaces thereof defines between the end plate means one or more moving volumes originating at a radially outer portion of the wrap elements and progressing radially inwardly to an inner portion thereof, which moving volumes are bounded initially by a single, leading moving line of coaction, then by both leading and trailing lines of coaction so as to define a closed moving volume, thence by a single trailing line of coaction so as to define a discharge volume. Port means are provided for admitting a working gas at suction pressure to the suction volumes about the periphery of the wrap elements and for discharging compressed gas from a radially inner portion of the wrap elements. In order to selectively vary the capacity of the gas compressor, passage means are provided extending through the end plate means from a location in communication with the closed moving volumes from at least the time they are formed by their trailing moving line of coaction until they have progressed radially inwardly to a predetermined position, to a location in communication with working gas normally at suction pressure during operation of the compressor. Valve means are further provided for selectively blocking flow through the passage means, whereby the gas compressor operates at a relatively high capacity; and for permitting flow through the passage means, whereby gas is exhausted via the passage means from said closed moving volume as it is reduced in volume and until it has progressed radially inwardly to the aforesaid predetermined position, whereby the capacity of the compressor is reduced.

In the preferred embodiment, the end plate means comprise a first end plate sealingly affixed to a first axial tip portion of the first wrap element and a second end plate sealingly affixed to a first axial tip portion of the second wrap element; and wherein means are provided for maintaining the second wrap element and end plate in a fixed position while the drive means are operative to drive the first wrap element and end plate in an orbital path with respect thereto. In this embodiment, the passage means conveniently extend through the second, fixed end plate. The compressor is disposed within a hermetic shell to which working gas is admitted such that the interior thereof is maintained at suction pressure, such that the passage means extend through the second end plate to a location in communication with the interior of the shell. In this manner, working gas which is exhausted from the closed moving volumes via the passage means is simply returned to the interior of the hermetic shell without the need for additional fluid flow passages.

The valve means associated with the unloader means preferably include a valve element movable between a first position blocking flow through the passage means and a second position permitting flow therethrough, said valve element having a generally planar surface which lies substantially flush to a generally planar surface of the end plate means. In this manner, no undesirable clearance volume is introduced into the compressor which would impair its operating efficiency at full capacity, and leakage across the axial tip portion of the wrap element is minimized or avoided.

In order to provide the desired variation in capacity, the passage means referred to preferably comprise first and second passages extending through the end plate means, the first passage being at a location so as to be in communication with first and second closed moving volumes at least from the time they are formed by their associated trailing lines of coaction, and a second passage extending through the end plate means at a second location so as to be in communication with the first and second closed moving volumes at least from the time they are no longer in communication with the first passage as they progress radially inwardly toward the predetermined positions at which compression is permitted to begin. Through the provision of two such passages, three discrete capacities may be obtained: full capacity with both passages closed; a first reduced capacity with the radially outer passage open; and a second further reduced capacity with both passages open.

In the preferred embodiment, the valve means are actuated to their position blocking flow through the passage means by working gas at discharge pressure such that, at startup of the compressor from a standing start, the valve means are in their open position permitting flow through the passage means until the discharge pressure of the compressor reaches a predetermined value. This arrangement has the advantage of permitting the compressor to start in an unloaded condition, reducing the torque required.

Accordingly, it is a primary object of the present invention to provide a gas compressor of the scroll type which includes unloader means for selectively varying its capacity by delaying the point at which compression of the working gas begins as the closed moving volumes defined between wrap elements of the compressor progress radially inwardly.

It is a further, related object of the invention to provide such a compressor which is disposed within a hermetic shell maintained at suction pressure, such that the passage means associated with the unloader means are extremely simple and compact, obviating the need for more complicated flow circuitry in order to realize the advantages of the invention.

Yet another object of the invention is to provide a valve arrangement for the passage means which does not interfere with normal operation of the compressor and, in particular, does not effect its operating efficiency.

A fourth object of the invention is to provide a gas compressor having at least three discrete operating capacities, through the provision of two passages so-located as to bring about the desired variations in capacity.

These and further objects of the invention will become apparent from the detailed description of the invention which follows, and by reference to the accompanying drawings.

BRIEF DESCRIPTION OF THE DRAWINGS

FIG. 3 is a cross section view taken along line 3—3 of FIG. 1.

FIG. 4 is a series of cross section views taken along line 4—4 of FIG. 1, illustrating the wrap elements at sequential operating positions taken at 90° intervals.

FIG. 5 is a series of cross section views similar to those of FIG. 4 illustrating a second embodiment of the invention.

FIG. 6 is a cross section view taken along line 6—6 of FIG. 4 illustrating in detail the valve means of the present invention.

BEST MODE FOR CARRYING OUT THE INVENTION

Figure 1:
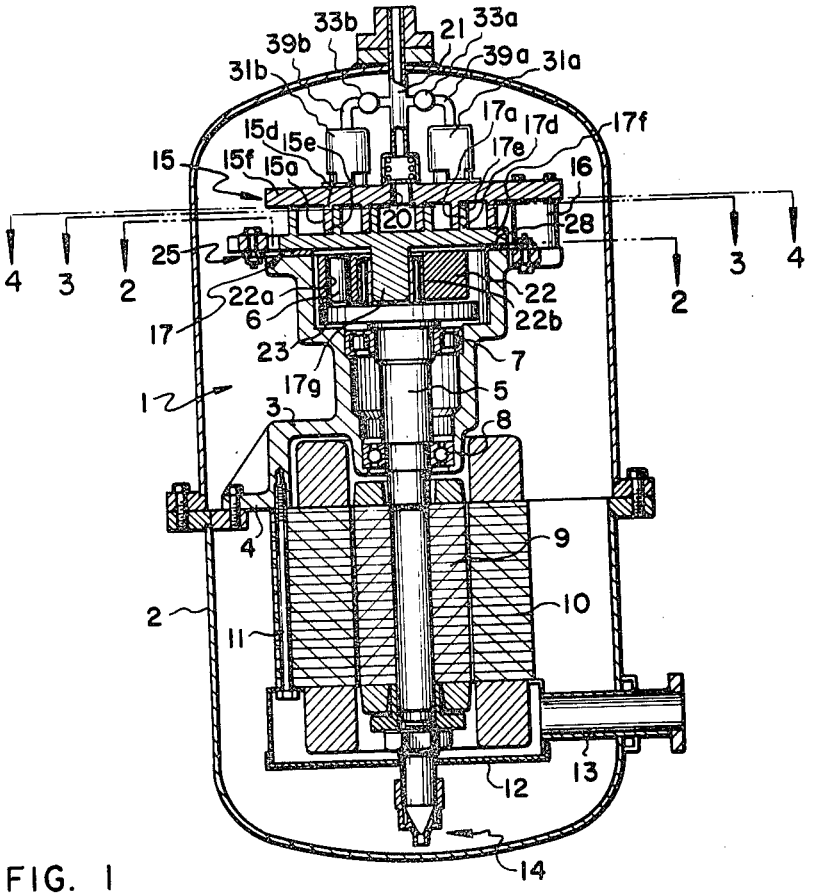
FIG. 1 is a vertical cross section view taken along the line 1—1 of FIG. 2.

Turning to FIG. 1, fluid apparatus of the positive displacement scroll type are illustrated in the form of a gas compressor indicated generally by reference numeral 1, and disposed within a hermetic casing or shell 2. A crankcase housing 3 includes a plurality of supporting legs 4 which are suitably affixed to the inner periphery of shell 2 so as to support the compressor therein.

Crankshaft means are rotatably supported within housing 3 and include a shaft 5 rotatable on a shaft axis and crank means 6 in the form of a crank pin or stub shaft affixed thereto and radially offset therefrom along a crank axis. In the embodiment illustrated in FIG. 1, shaft 5 is supported by an upper roller bearing assembly 7 and a lower ball bearing assembly 8, which bearings also serve to support any axial loads imposed upon shaft 5 due to the shoulders machined on shaft 5 and housing 3, as shown.

An electric drive motor includes a rotor 9 affixed to the lower end of shaft 5 and a stator 10 fastened to housing 3 by a plurality of bolts 11. Surrounding the lower end of stator 10 is a shroud 12 for receiving gas to be compressed from inlet conduit 13 and directing same over the drive motor for cooling purposes.

The lowermost end of shaft 5 includes a centrifugal oil pump, indicated generally by reference numeral 14, which pumps oil from a sump in the lower portion of shell 2, via one or more axial passages in shaft 5, to the various components of the compressor requiring lubrication. Since the particulars of the lubrication system do not form a part of the present invention, nor is an understanding thereof critical to the invention, no detailed explanation thereof is believed warranted. Reference may be had to U.S. Pat. No. 4,064,279 for an example of this type lubrication system.

Affixed to the upper portion of housing 3 is a fixed, or second, scroll member indicated generally at 15 and comprising a second wrap element **15*a* which, as best seen in FIG. 3, defines respective inner and outer flank surfaces 15*b* and 15*c* of generally spiroidal configuration about a second axis and extending between a first axial tip portion 15*d* and a second axial tip portion 15*e*. Scroll member 15 further includes end plate means in overlying, substantially sealing relationship to axial tip portion 15*d* and, in the embodiment illustrated, comprise an end plate 15*f* sealingly affixed to axial tip portion 15*d*. Scroll member 15, including wrap element 15*a* and end plate 15*f*, may be machined from a single casting or block of material; or, in the alternative, wrap element 15*a* may be formed separately and then suitably attached to end plate 15*f*. By reference to FIGS. 1 and 2, it can be seen that end plate 15*f* is attached to housing 3 by four column members 16** spaced about its periphery.

An orbiting, or first scroll member indicated generally at 17 includes a first wrap element **17*a* which, as best seen in FIG. 3, defines respective inner and outer flank surfaces 17*b* and 17*c* of generally spiroidal configuration about a first axis and extending between a first axial tip portion 17*d* and a second axial tip portion 17*e*. Scroll member 17 also includes end plate means in overlying, substantially sealing relationship to axial tip portion 17*d* and, in the embodiment illustrated, comprise a first end plate 17*f* sealingly affixed to axial tip portion 17*d*. Scroll member 17 may be fabricated using those techniques, outlined with respect to scroll member 15**.

From FIGS. 1 and 3, it can be seen that first and second wrap elements **17*a* and 15*a*, respectively, are disposed in intermeshing, angularly offset relationship with their axes generally parallel, and such that second axial tip portions 17*e* and 15*e* extend to positions in substantial sealing relationship with end plates 15*f* and 17*f*, respectively. Although not illustrated for the sake of clarity, axial tip portions 17*e* and 15*e*** may advantageously be provided with tip seals in order to improve compressor performance by reducing leakage. A variety of such tip seals are disclosed in U.S. Pat. No. 3,994,636.

By reference to FIG. 3, it can be seen that wrap elements **15*a* and 17*a* define a first series of moving volumes 18*a*, 18*b* between flank surfaces 15*b* and 17*c*; and a second series of moving volumes 19*a*, 19*b* between flank surfaces 17*b* and 15*c*; which volumes progress radially inwardly as wrap element 17*a* orbits with respect to wrap element 15*a* in a counterclockwise direction as viewed in FIG. 3. Volumes 18*a*, 19*a* comprise suction volumes bounded by a single, leading line of coaction, while volumes 18*b*, 19*b* are bounded by both leading and trailing lines of coaction and are reduced in volume as wrap element 17*a* undergoes orbital motion until the volumes are bounded by only a trailing line of coaction and the compressed gas is discharged via port 20 and discharge conduit 21**.

Thus, compressor 1 receives gas to be compressed from conduit 13 after it has passed over the drive motor as previously described, which gas enters volumes **18*a*, 19*a* from about the periphery of wrap elements 15, 17, and is discharged therefrom via port 20 and conduit 21**.

Figure 2:
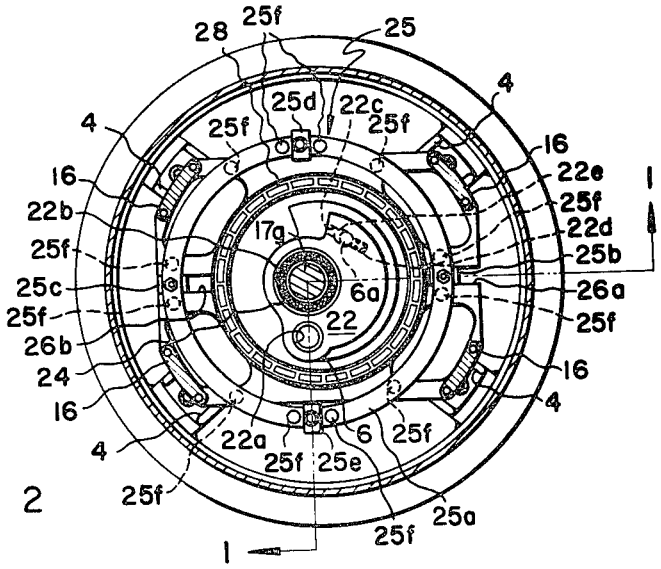
FIG. 2 is a cross section view taken along line 2—2 of FIG. 1.

In order to impart orbiting motion to scroll member 17, radially compliant drive means are provided such that actual moving line contact is permitted between the flank surfaces of wrap elements **15*a* and 17*a*, and a sealing force acts therebetween. As shown in FIGS. 1 and 2, such means include linkage means operatively interconnecting shaft 5 and wrap element 17*a* via its attached end plate 17*f*, which linkage means comprise a linkage member 22 having a first bore 22*a* rotatably engaging stub shaft 6 of crankshaft 5; and a second bore 22*b* rotatably engaging a stub shaft 17*g* depending from end plate 17*f* along a third axis. Suitable bearing means such as journal bearing 23 between bore 22*a* and stub shaft 5; and roller bearing 24 between bore 22*b* and stub shaft 17*g*** are provided as shown.

From FIG. 2 it can be seen that stub shaft **17*g* of scroll member 17 is free to undergo at least limited motion in a radial direction with respect to the axis of shaft 5 as linkage member 22 pivots or swings about the axis of stub shaft 6, thereby permitting actual line contact between the flank surfaces of wrap elements 17*a* and 15*a*. It can further be seen that, upon rotation of shaft 5, scroll member 17 will undergo orbital motion with respect to fixed scroll member 15**.

Linkage member 22 further includes a bore **22*c* containing a spring 22*d*; and an axial bore 22*e* which receives a pin 6*a* affixed to shaft 5. When compressor 1 is at rest, spring 22*d* urges scroll member 17 in a radially inward direction so as to provide a clearance between the flank surfaces of wrap elements 15*a* and 17*a***, thereby reducing the initial torque required at start-up.

In order to maintain a fixed angular relationship between scroll members 15 and 17 and their associated wrap elements **15*a*, 17*a*; means are provided in the form of an Oldham coupling 25 which includes a circular ring 25*a* having a first pair of blocks 25*b*, 25*c* which are pivotally mounted thereto and slideably engage slots 26*a*, 26*b* in the upper portion of housing 3. A second pair of blocks 25*d*, 25*e* are likewise pivotally mounted to ring 25*a* and slideably engage slots 27*a*, 27*b* in end plate 17*f* (see FIG. 3). In this manner, orbiting scroll member 17 is restrained from angular displacement while permitted to undergo circular translation with a variable circular orbiting radius. Ring 25*a* is further provided with a plurality of pads 25*f* which slideably engage surfaces machined on the upper portion of housing 3 and on orbiting scroll member 17**. Reference may be had to U.S. Pat. No. 4,065,279 for disclosure of a similar Oldham coupling member.

Orbiting scroll member 17 is supported during its orbital motion by a thrust bearing 28 adequate to absorb the axial pressure forces to which scroll member 17 is subjected during operation. U.S. Pat. No. 4,065,279 also discloses one type of thrust bearing suitable for use in this application.

Turning next to FIGS. 4(*a*) through 4(*d*) of the drawings, it can be seen that end plate 15*f* of the second, or fixed scroll member includes passage means extending therethrough which comprise a first passage 29*a* and a second passage 29*b*. These passages extend from a location in communication with closed moving volumes 18*b* and 19*b* to a location in communication with working gas normally at suction pressure during operation of the compressor. This is best illustrated by reference to FIG. 6 wherein it can be seen that passages 29*a* and 29*b* extend through end plate 15*f* to a position in communication with the interior of hermetic shell 2 which, as previously discussed, contains working gas at suction pressure after it has passed over the motor for cooling purposes.

Continuing with reference to FIGS. 4(*a*) through 4(*d*), the functions of first and second passages 29*a* and 29*b*, respectively, may best be illustrated by following one of the closed moving volumes, such as 18*b*, as it progresses radially inwardly due to wrap element 17*a* moving counterclockwise in its orbital path. Starting at FIG. 4(*b*), it is apparent that closed moving volume 18*b* has just been closed off by its trailing line of coaction and that it is in communication with first passage 29*a*. Volume 18*b* remains in communication with first passage 29*a* until approximately the position of FIG. 4(*c*), at which time volume 18*b* has progressed to a position in communication with second passage 29*b*, with which it remains in communication until it progresses radially inwardly to a position intermediate those illustrated in FIGS. 4(*a*) and 4(*b*). Only at this time is compression of the working gas permitted to begin since, assuming valve elements 30*a* and 30*b* to be in their open positions (as will be described hereinafter), the working gas within volume 18*b* is exhausted therethrough and returned to the interior of hermetic shell 2 which is at suction pressure.

In a similar fashion, closed moving volume 19*b* may be followed as it progresses radially inwardly from the position of FIG. 4(*b*) where it is initially formed by its trailing line of coaction and where it is in communication with first passage 29*a* until it reaches approximately the position of FIG. 4(*a*). At this point it will be noted that volume 19*b* is in communication with second passage 29*b*, with which it remains in communication until wrap element 17*a* reaches a position intermediate FIGS. 4(*c*) and 4(*d*), at which compression of the working gas therein is permitted to begin. It may thus be noted at this time that, since passages 29*a*, 29*b* have a dimension in the radial direction substantially equal to the distance between turns of wrap element 15*a*, that a closed moving volume lying on either side of wrap element 17*a* is placed in communication with the passage.

It will be appreciated that, by delaying the point at which compression of the working gas is permitted to begin, the effective capacity of the compressor is reduced in that a smaller quantity of working gas passes through the compressor, due to the reduced volume of the closed moving volumes 18*b*, 19*b*, at which compression begins.

Turning next to FIG. 6, the valve means provided for selectively blocking flow through the passage means comprising first and second passages 29*a* and 29*b*, respectively, will be described. Particularly, it will be noted that each passage 29*a* and 29*b* comprises a stepped bore extending axially through end plate 15*f*, with a correspondingly shaped valve element or piston 30*a*, 30*b* disposed therein. Each such valve element is slideably disposed within a valve housing 31*a*, 31*b* suitably affixed to the upper surface of end plate 15*f*. Valve housings 31*a*, 31*b* are mounted to end plate 15*f* by a number of legs or feet spaced about the periphery of the housing so as to leave substantial open area therethrough for the flow of working gas. As further shown in FIG. 6, valve elements 30*a* and 30*b* are biased toward open positions by helical coil springs 32*a* and 32*b*, respectively.

Valve elements 30*a* and 30*b* may be actuated between a first position illustrated in FIG. 6 wherein flow through respective passages 29*a* and 29*b* is blocked; and a second position shown in dotted line wherein flow therethrough is permitted. To this end, valve housings 31*a* and 31*b* may both be selectively placed in communication with working gas at discharge pressure via respective conduits 39*a* and 39*b*, under control of solenoid valves 33*a* and 33*b*. Thus, when valves 33*a* and 33*b* are in their open positions, discharge gas at a relatively high pressure is sufficient to overcome the spring force provided by springs 32*a* and 32*b*, as well as the gas pressure force acting on surfaces 38*a*, 38*b*, in order to urge valve elements 30*a* and 30*b* to their closed positions; while upon closure of valves 33*a* and 33*b*, the high pressure gas disposed within valve housings 31*a* and 31*b* will leak past valve elements 32*a* and 32*b*, allowing them to be moved to their second, open positions under the influence of springs 32*a* and 32*b*. It is particularly important to note at this time that, by requiring discharge gas pressure to urge valve elements 30*a* and 30*b* to their closed positions, an operating advantage is attained because, at startup of the compressor, the valve elements will be in their open positions, reducing the capacity of the gas compressor, and thereby reducing the starting torque required of the drive motor. Once the compressor has reached operating speed, the discharge pressure will increase to an operating level sufficient to urge the valve elements to their closed positions, assuming valves 33*a* and 33*b* to be in their open positions. It should further be noted at this time that this arrangement has utility in a compressor either with or without the particular linkage member 22 which, as previously disclosed, also serves to reduce starting torque requirements.

It is further important to note the precise shape and configuration of valve elements 30*a* and 30*b* and the manner in which they cooperate with end plate 15*f*. Particularly, each of valve elements 30*a* and 30*b* include a generally planar surface 38*a* and 38*b* lying substantially flush to the generally planar surface of end plate 15*f*. In this manner, there is no void space which could trap gas at high pressure and permit re-expansion thereof to a lower pressure as wrap element 17*a* passes thereover. This is an important consideration in that any such re-expansion of working gas would represent a loss and inefficiency within the compressor. This arrangement also prevents any substantial leakage over axial tip portion 17*e* of wrap element 17*a*.

By reference to FIGS. 1 and 6 it may also be seen that pressure responsive valve means are disposed immediately downstream from discharge port 20 and comprise a generally flat, planar valve element which cooperates with an upstanding valve seat 20*a* disposed about the peripery of discharge port 20. Valve element 34 is preferably of circular shape, corresponding to that of discharge port 20, and includes a plurality of tabs 34*a* extending radially outwardly from the periphery thereof in order to guide same for sliding motion within housing 36. A coil spring 35 is disposed between valve element 34 and the upper wall of housing 36 so as to bias the valve element to a closed position. As the pressure of working gas within discharge port 20 increases, it will act upon the lower surface of valve element 34 and impose a force thereon so as to move the valve element to an open position, such that working gas can flow around the circumference of valve element 34, and out discharge conduit 21. In this manner, back flow from discharge conduit 21 into discharge port 20 will be prevented, and the compressor will be required to increase the pressure of working gas at least to a level equal to that existing downstream from valve element 34, which pressure acts upon the upper side of the valve element.

Turning now to FIG. 5 of the drawings, a second embodiment of the invention will be described wherein the distinction over the preceding embodiment lies in the particular shape and location of the passage means which extend through end plate 15*f*. As shown, first, second, and third passages 37*a*, 37*b*, and 37*c*, respectively, are provided. It will further be noted that passages 37*a* and 37*b* comprise circular bores as in the preceding embodiment, while third passage 37*c* comprises an elongated passage having a dimension in the radial direction which is less than or equal to the width of wrap element 17*a*.

Operation of the embodiment illustrated in FIGS. 5(*a*) through 5(*d*) may also be visualized by following closed moving volume 18*b* from its position of FIG. 5(*b*) where it has been initially formed by its trailing line of coaction, and where it lies in communication with first passage 37*a* as well as second passage 37*b*. Volume 18*b* remains in communication with first passage 37*a* only briefly, and by the time it has progressed to the position of FIG. 5(*c*) it is in communication only with second passage 37*b*, with which it remains in communication until approximately the position of FIG. 5(*a*), where volume 18*b* is in communication with third passage 37*c* until it reaches approximately the position of FIG. 5(*c*) whereat compression is permitted to begin. Likewise, closed moving volume 19*b* may be followed from its initial position of FIG. 5(*b*) where it is in communication with first passage 37*a*, with which it remains in communication until approximately the position of FIG. 5(*d*) whereat volume 19*b* is in communication with second passage 37*b*. Volume 19*b* remains in communication with passage 37*b* until approximately the position of FIG. 5(*c*) whereat compression is permitted to begin.

It may thus be noted that the embodiment of FIGS. 5(*a*) through 5(*d*) is characterized in that compression in both moving volumes 18*b* and 19*b* is permitted to begin at substantially the same point in time, e.g., the position of FIG. 5(*c*). Thus, the compression characteristics of volumes 18*b* and 19*b* will be substantially identical. It will be further appreciated with respect to the embodiment of FIGS. 5(*a*) through 5(*d*) that valve means similar to that illustrated with respect to the preceding embodiments may be provided in order to effect the selective closing of first, second, and third passages 37*a*, 37*b*, and 37*c*, respectively; although it may be noted that the passage 37*c* would require a valve element of specialized form in order to cooperate with the particular shape of that passage.

From the foregoing description of preferred embodiments of the invention, it should be apparent that the objects of the invention set forth previously have been met. It should be expressly noted, however, that although the invention is described with respect to such preferred embodiments, modifications thereto will become apparent to those skilled in the art upon a consideration thereof. Accordingly, the scope of the invention is to be determined by reference to the claims which follow.

We claim:

1. A gas compressor of the positive displacement scroll type comprising a. a first wrap element defining inner and outer flank surfaces of generally spiroidal configuration about a first axis and extending between first and second axial tip portions;

b. a second wrap element defining inner and outer flank surfaces of generally spiroidal configuration about a second axis and extending between first and second axial tip portions, said first and second wrap elements being disposed in intermeshing, angularly offset relationship with their respective axes generally parallel;

c. end plate means comprising a first end plate sealingly affixed to the first axial tip portion of said first wrap element and a second end plate sealingly affixed to the first axial tip portion of said second wrap element, the second axial tip portions of said first and second wrap elements extending to a point in substantial sealing relationship to said second and first end plates respectively; further comprising means for maintaining said second wrap element and end plate in a fixed position;

d. drive means operative to drive said first wrap element and end plate in an orbital path with respect to said second wrap element and end plate such that moving line coaction between the inner facing flank surface of said first wrap element and the outer facing flank surface of said second wrap element, and between the outer facing flank surface of said first wrap element and the inner facing flank surface of said second wrap element, defines between said end plate means first and second moving volumes originating at a radially outer portion of said wrap elements and progressing radially inwardly to a radially inner portion thereof, said volumes being bounded initially by a single, leading moving line of coaction so as to define a suction volume; then by both leading and trailing lines of coaction so as to define a closed moving volume which is progressively reduced in volume as it moves radially inwardly; and finally by a single trailing line of coaction so as to define a discharge volume;

e. port means for admitting a working gas at a suction pressure to said suction volumes and for discharging compressed gas from said discharge volume; and f. unloader means for selectively varying the capacity of said gas compressor comprising i. a first passage extending through said second end plate at a first location in communication with said first and second closed moving volumes at least at the time they are formed by said trailing lines of coaction, to a location in communication with working gas normally at suction pressure during operation of said compressor, said first passage having a dimension in a radial direction such that, as said first wrap element undergoes relative orbital motion with respect thereto, a closed moving volume lying on either side thereof is placed in communication with said first passage as the first wrap element passes thereover;

ii. a second passage extending through said second end plate at a location in communication with said first and second closed moving volumes at least from the time they are no longer in communication with said first passage and until they progress radially inwardly to predetermined positions, to a location in communication with working gas normally at suction pressure during operation of said compressor, said second passage being disposed radially inwardly from said first passage and having a dimension in a radial direction such that, as said first wrap element undergoes relative orbital motion with respect thereto, a closed moving volume lying on either side thereof is placed in communication with said second passage as said first wrap element passes thereover; and iii. valve means for selectively blocking flow through said first and second passages whereby said gas compressor operates, at a relatively high capacity; and for permitting flow through said passages whereby gas is exhausted via said passages from said closed moving volumes as they are reduced in volume until they have progressed radially inwardly to the aforesaid predetermined positions, whereby the capacity of said gas compressor is reduced.

2. The gas compressor of claim 1, further comprising means for maintaining a fixed angular relationship between said first wrap element and end plate and said second wrap element and end plate.

3. The gas compressor of claim 1 wherein said gas compressor is disposed within a hermetic shell, and wherein working gas is admitted to said shell such that the interior thereof is at suction pressure; said first and second passages extending through said second end plate to a position in communication with the interior of said shell.

4. The gas compressor of claim 1 wherein said valve means are actuated to their position blocking flow through said first and second passages by working gas at a discharge pressure, whereby, at startup of said compressor from a standing start, said valve means permit flow through said first and second passages until said discharge pressure reaches a predetermined value and thereby reduces the torque required to start said compressor.

5. The gas compressor of claim 1 further including pressure responsive valve means disposed immediately downstream from said discharge port means, said valve means being operable to prevent flow therethrough unless the pressure of discharge gas upstream therefrom is at least equal to the pressure downstream therefrom.

6. The gas compressor of claim 1 wherein said second passage extends through said end plate means at a second location such that said second closed moving volume remains in communication therewith after said first closed moving volume is no longer in communication therewith as said closed moving volumes progress radially inwardly.

7. The gas compressor of claim 6 further comprising a third passage extending through said second end plate at a location such that said first closed moving volume is in communication therewith at least from the time it is no longer in communication with said second passage, and until said second closed moving volume is no longer in communication with said second passage; whereby said first and second moving volumes exhibit substantially identical compressing characteristics.

8. The gas compressor of claim 7 wherein said third passage has a dimension in the radial direction which is less than or equal to the thickness of said first wrap element and is disposed adjacent the inner flank surface of said second wrap element, whereby said first closed moving volume is removed from communication with said third passage as said first wrap element passes thereover.

9. The gas compressor of claim 1 wherein said second end plate includes a generally planar surface in overlying, substantially sealing relationship to the second axial tip portion of said first wrap element; and wherein said valve means include first and second valve elements movable between first positions blocking flow through said first and second passages, respectively, and second positions permitting flow therethrough; each of said valve elements when in said first position including a generally planar surface lying substantially flush to the generally planar surface of said second end plate.

10. The gas compressor of claim 9 wherein said first and second passages each comprise a circular bore extending through said second end plate and each of said first and second valve elements comprises a cylindrical member movable axially within its respective bore and having an axial end portion defining its generally planar surface.

11. The gas compressor of claim 1 wherein each of said first and second passages have a dimension in a radial direction substantially equal to the distance between adjacent turns of said second wrap element.

12. The gas compressor of claim 11 wherein each of said first and second passagers comprise circular bores.

* * * * *